US005660867A

United States Patent [19]

Reynolds et al.

[11] Patent Number: 5,660,867

[45] Date of Patent: Aug. 26, 1997

[54] PACKAGED BEVERAGES AND PACKAGING THEREFOR

[75] Inventors: Andrew John Reynolds, Huntingdon; John David Skingsley, Letchworth; Stephen Michael Freshwater, Cherry Hinton; John Kelshaw Conway, Sawston; Peter Erich Cox, Cherry Hinton; John Poley, Royston, all of United Kingdom

[73] Assignee: Courage Limited, United Kingdom

[21] Appl. No.: 481,527

[22] PCT Filed: Dec. 23, 1993

[86] PCT No.: PCT/GB93/02639

§ 371 Date: Jun. 20, 1995

§ 102(e) Date: Jun. 20, 1995

[87] PCT Pub. No.: WO94/14678

PCT Pub. Date: Jul. 7, 1994

[30] Foreign Application Priority Data

| | | | |
|---|---|---|---|
| Mar. 19, 1993 | [GB] | United Kingdom | 9305726 |
| Sep. 9, 1993 | [GB] | United Kingdom | 9318696 |
| Oct. 20, 1993 | [GB] | United Kingdom | 9321599 |
| Dec. 23, 1993 | [GB] | United Kingdom | 9226780 |

[51] Int. Cl.[6] ..... B65B 31/00; B65B 17/00; B65B 25/00

[52] U.S. Cl. ..... 426/112; 426/115; 426/124; 426/131; 426/132; 206/222; 220/501; 220/553

[58] Field of Search ..... 426/106, 112, 426/115, 124, 131, 397, 398, 394, 474, 477; 53/420, 432, 433, 471, 474; 220/222, 501, 553; 206/222

[56] References Cited

U.S. PATENT DOCUMENTS

| | | | |
|---|---|---|---|
| 4,518,082 | 5/1985 | Ye | 206/217 |
| 4,832,968 | 5/1989 | Forage et al. | 426/112 |
| 5,231,816 | 8/1993 | Lynch et al. | 53/432 |
| 5,514,393 | 5/1996 | Lynch et al. | 426/112 |

FOREIGN PATENT DOCUMENTS

| | | |
|---|---|---|
| 0 448 200 A1 | 9/1991 | European Pat. Off. . |
| WO92/00897 | 1/1992 | WIPO . |
| WO93/15973 | 8/1993 | WIPO . |

*Primary Examiner*—Esther Kepplinger
*Assistant Examiner*—Curtis E. Sherrer
*Attorney, Agent, or Firm*—Lee, Mann, Smith, McWilliams, Sweeney & Ohlson

[57] ABSTRACT

Devices are described for fitting into pressurized individually packaged beverages (typically canned beers, ales and stouts), by which gas at high pressure is stored within the package for jetting into the beverage as the package is opened to atmosphere. One embodiment comprises a length of tube (10) having a gas jetting orifice (14) which in use is submerged below the beverage in a pressurized can having a gaseous headspace, which can be used to charge the tube with gas during the passage of the filled can (16) along a conventional canning line, on which the can is inverted after filling which brings the orifice into the gaseous headspace. A more preferred design of device comprises a molded plastics capsule (34; 50;78) secured near the bottom of a can (20, 88) with an internal, preferably central, pipe (56; 62; 80) to provide a liquid seal to prevent loss of gas when the can is inverted from the upright position, and an airlock when the can is upright, to prevent beverage which has entered the capsule from leaving it when the can is opened to atmosphere. A further design of capsule (96) having a central internal pipe (98) and adapted to be pressurized solely by the ingress of beverage, which is fitted midway down the can (94) but which still only jets gas on opening, is also described.

26 Claims, 7 Drawing Sheets

PACKAGED BEVERAGES AND PACKAGING THEREFOR

FIELD OF THE INVENTION

This invention concerns the packaging of beverages including alcoholic beverages such as beer, lager, ale and stout which are sold in packaged form in sealed bottles and cans. The invention also lies in an improved package for such beverages particularly cans for alcoholic beverages as aforesaid and for devices for fitting in such packages particularly cans, to alter the characteristics of the beverage when it is dispensed from the package.

This invention is of particular application to canned beers particularly of the type containing dissolved nitrogen and carbon dioxide. The expression beer is intended to include any alcoholic beverage such as ale, beer, porter, stout and the like.

BACKGROUND TO THE INVENTION

It is characteristic of some alcoholic beverages especially stout and traditional ales and beers to generate a foamy head of gaseous bubbles during the dispensing of the beverage into a glass and to consume the drink with this head evident upon the liquid. The source of gas for the bubbles is the gases dissolved in the beverage which are caused to break out of solution through a nucleation process. When dispensing from the bar this nucleation process has been stimulated by forcing the beverage under very high pressure through small nozzles which create sufficient sheer force to stimulate gas nucleation.

It is also known that if nitrogen is dissolved in such beverages, the bubbles are smaller, more stable and are perceived as creamier than when only carbon dioxide is present. It has therefore become common practice to add nitrogen to certain beers, ales and stouts. To maintain the nitrogen in solution, nitrogen has been used in the gas over pressure dispensing systems for dispensing such beverages so as to promote a stable and creamy head.

It has also become commonplace to add nitrogen to canned alcoholic beverages as aforesaid and to pressurise the can with nitrogen to the extent of adding liquid nitrogen during filling, so that after the can is sealed the evaporating dose of liquid nitrogen will increase the internal pressure typically to two atmospheres or more.

The can pressurisation has enabled thinner walled cans to be used and the use of non-oxidising gas for the pressurisation (after purging the can and contents of all oxygen), has ensured that oxygen will be absent from the interior of the can. If nitrogen is used, it will be taken up by, and become dissolved in, the beverage, so that if the latter can be stimulated to give up the nitrogen on dispensing, a rich creamy head of nitrogen bubbles will be formed on the beverage.

Various techniques have been adopted to stimulate the bubble formation on dispensing from such a pressurised can.

Early attempts are described in GB 1266351 particularly in relation to FIG. 3, wherein a secondary chamber is defined within the can which is adapted to retain a charge of gas under pressure, which discharges into the beverage through a fine orifice, driven by the pressure difference arising immediately after the can is opened to atmospheric pressure by the consumer.

Practical difficulties with this described technique apparently prevented commercial application for many years. The problems included the complexity and cost of modification to standardise packaging, the necessity to develop specialised can or bottle filling equipment for non-standard packages, the necessity to minimise oxygen in the package usually causes a beverage to change in flavour, the requirement that there should be minimal reduction in effectiveness of the gassing device caused by temperature and pressure fluctuation which can arise during transportation and distribution, and that the end product appearance and taste should be independent of the procedure used by the consumer to open and pour the packaged beverage.

Some of these difficulties were overcome by the use of a secondary chamber in the form of a capsule disclosed in EP 227213A2 in which the secondary chamber is pressurised from the primary container and its contents discharged through a permanently open orifice in the side wall of the capsule into the beverage when the can is opened.

Problems associated with the fitting and retention of such capsules resulted in other proposals such as described in GB 2211813A (Price) in which the secondary chamber is formed by an apertured diaphragm which divides the interior of the can into an upper larger part and a smaller lower part. It had already been proposed in EP 227213 to used an oversize can so as to provide a headspace in the can above the beverage. This not only provided space into which the creamy head could rise but also allowed for the additional volume of the capsule (or separate compartment such as proposed in GB 2211813A Price) and for the extra beverage required to compensate for any beverage trapped in the capsule of EP 227213 or the lower compartment of GB 2211813A Price.

The quantity of beverage in the secondary compartment is clearly minimised by inverting the can as has been commonplace between filling and pasturisation since the introduction of the two-piece can following the published recommendation of the UK can manufacturer concerned as early as 1981. This inversion causes the orifice in the secondary compartment to communicate with the gaseous headspace, as described in GB 2211813A Price.

Whilst the Price design allows all the beverage to drain from the secondary chamber, this is only achieved if the can is not only inverted during processing but is then left inverted until just before being opened. Price suggested that to this end the can should be printed "upside down" so that there would be a chance that the purchaser would place the cans in their inverted state whilst awaiting use. However there was no guarantee that the cans would be so stored, in which event the lower compartment would be filled with beverage.

Although this would be under pressure and would jet through the aperture or apertures in the diaphragm of Price when the can was opened to atmospheric pressure, the results of such jetting of beverage did not result in any useful head formation and unlike the capsule of EP 227213A2 the diaphragm of Price could not allow a pocket of gas to be trapped to be discharged instead of (or as well as) some of the beverage.

It can only be concluded that the Price proposal was not taken up since it could not be guaranteed that the consumer would store the can upside down and invert sufficiently quickly before opening, to prevent any of the beverage from transferring below the diaphragm. Additionally there was no significant advantage to the manufacturer since the canning of the product still had to provide excess beverage over and above what the can was stated to contain in case the can was not stored the correct way up and thereby trapped beverage below the diaphragm.

EP 360375A1 describes a further development which combines the advantage of the capsule of EP 227213A (in that gas can be trapped by the device when the can is upright) with the price proposal for a diaphragm (so as to avoid the capsule fitting and retention problems). Clearly there will always be a charge of gas trapped below the domed diaphragm of EP 360375A1 which can be maximised (and the volume of beverage minimised) if the can is inverted and left so inverted as taught by Price.

EP 360375A1 describes an alternative method of constructing a domed diaphragm and an alternative filling process in which the can is filled upside down, to ensure the compartment will be filled with gas before the can is turned over to stand on its base with the domed compartment at the bottom. Since the specification envisages dosing with liquid nitrogen the pressure of the gas in the section of the can between the lid and the domed diaphragm will be greater than atmospheric very shortly after the can is sealed and this will ensure that a good charge of high pressure gas is available below the domed diaphragm when the can is subsequently inverted.

However as shown in the drawings of EP 360373, there is still a tendency for beverage to displace some of the gas at least up to the level of the aperture. As a consequence although the high pressure gas trapped below the dome will be jetted into the beverage (together possibly with some of the beverage) so as to form the desired head when dispensed, the beverage below the aperture will remain in the base of the can in the same way as it remains below the level of the aperture in the capsule of EP 227213.

The trapped beverage represents lost revenue which can be significant in the case of alcoholic beverages, particularly if tax is levied on the volume of beverage poured into the can rather than on the volume which can be poured out.

The loss of revenue can be mitigated in two ways:

1. reduce the cost of the gas-storing head-producing device and the cost of inserting it into the can, and/or
2. reduce the volume of beverage which can be trapped within the gas producing device.

PCT/GB90/01806 (Whitbread) addresses the second option by proposing a sealed gas containing device into which beverage cannot ingress and which only opens to communicate with the beverage after the can has been opened and depressurised, so that there should be no reverse transfer of beverage into the capsule as gas leaves it. However the cost of production of such devices is not inconsiderable and the complexity of the pressure sensitive mechanism of the device to release the gas only when the can is opened, means that in practice there has been a relatively high failure rate, resulting in poor or even no head formation on beer dispensed from faulty cans.

EP 520646A1 describes a modified construction of the type of capsule described in EP 227213 which is also charged with gas from the headspace following headspace transfer by means of can inversion, as described in UK 2211813 Price.

The design of the capsule allows any beverage which has entered the capsule to be collected below the level of the aperture, so there is little tendency for it to be ejected ahead of or instead of the gas, provided the can is opened whilst upright. In this respect the device has the same advantage as the Price design, in that as with the Price device, no energy is wasted in ejecting beverage into the contents of the can, and it is gas only which is ejected.

It is suggested that the ingress of beverage into the capsule of EP 520646A1 can be reduced by inverting the can as quickly as possible after filling, but this seems to be nothing more than a restatement of the Price technique, in which, if the can is inverted immediately after filling and sealing, no beverage will have entered the lower chamber of Price, and in any event it has been commonplace to invert filled cans on canning lines within a few seconds of the final seaming of the can, for the reasons already mentioned.

The design of the capsule in EP 520646A1 is in many ways also similar to that shown in GB 1266351 in that the orifice by which the secondary chamber communicates with the rest of the can points downwardly towards the base of the can, so that an air/liquid lock is formed and there will be little tendency for beverage to displace any of the trapped gas, unless the can is tilted. The side tube design of GB 1266351 may of course include a small volume of beverage if there is a liquid exchange as during pasturisation, or thermal cycling of the can during storage, and in this respect the capsule of EP 529646A1 is better than that of GB 1266351 in that there is no slug of beverage to force out ahead of the gas charge. However the EP 520646A1 capsule suffers from a further problem in that, if as is likely to occur, some beverage does enter the capsule, since if the can is tilted with the orifice is on the underside of the capsule, any beverage trapped in the capsule will tend to occupy the position such as shown in FIG. 2 of EP 520646A1, except that in this case the beverage will now overlie the orifice 12, which in FIG. 2 is conveniently shown remote from the pool of liquid. Clearly if the liquid within the capsule does cover the orifice 10, the claimed advantage of an initial jetting of gas will be lost and because of the variableness of the volume of liquid in the capsule and the possibility that quite a large volume of liquid must be expelled from the capsule before the gas can escape, energy in the gas stored in the capsule will be lost as the liquid is expelled.

The capsule design of EP 520646A1 does not therefore solve the problems identified above regarding variability in the volume of retained beverage in the capsule and variability introduced into the gas jetting characteristic if a significant quantity of beverage occupies the interior of the capsule and can cover the exit orifice during pouring.

OBJECT OF THE INVENTION

It is one object of the present invention to provide an improved gas jetting device which minimises the effects on gas jetting caused by the ingress of beverage, and which can be fitted into a standard spun aluminium beverage can of the type commonly used for packaging carbonated drinks and alcoholoic beverages, particularly nitrogenated beers, stouts and the like.

It is another object of the present invention to provide an improved packaged beverage using a sealed container having a secondary compartment which communicates with the contents of the sealed container through a restricted orifice to jet gas when the container is broached ahead of dispensing.

It is another object of the present invention to provide an alternative device which communicates with the beverage contents of a sealed and pressurised can and which is adapted to retain a predictable volume of beverage which cannot be dispensed under normal usage.

It is another object of the present invention to provide apparatus and method by which capsules as aforesaid can be fitted into a can having a reduced diameter neck.

It is another object of the present invention to provide a very simple, easily insertable, low cost device, by which gas can be trapped for jetting into a beverage when a can fitted therewith is opened.

SUMMARY OF THE INVENTION

According to one aspect of the present invention there is provided an individually packaged beverage in a sealed and pressurised container, having a base on which it can stand upright and forming a primary chamber having push fitted therewithin a separate member defining secondary chamber means comprising at least in part a tube and where the secondary chamber communicates with the primary chamber an airlock is created at least while the container is upright thereby forming a gaseous headspace in the secondary chamber the said communication being effected by a small orifice in a downwardly facing region thereof through which gas trapped under pressure in the secondary chamber means can be released as a jet into the beverage when the package is opened to atmospheric pressure, to dispense beverage therefrom.

In one embodiment the secondary chamber defining member is a length of tube sealed at each end and the small orifice is provided in the wall of the tube intermediate the sealed ends thereof.

By selection of shape, length and material the tube can be designed for easy insertion, and retention of its location, within the beverage package.

One advantage of utilising a tube is that its internal volume may be readily flushed and filled with non-oxidising gas so as to expel oxygen therefrom before, or during, the manufacturing process of cutting and sealing the tube ends.

According to another aspect of the invention, the non-oxidising gas may be retained in a tube by a small bung of soluble material in the orifice, although if the injected gas is at atmospheric pressure and the orifice is very small (as is normally the case), there will be little tendency for gas exchange to occur for a reasonable period of time even without a bung.

By appropriate bending of the tube along its length and choice of location of the small orifice within the container as is well understood from the prior art already referred to, it is possible to design the secondary chamber so that it can be charged and pressurised with gas or beverage from the primary chamber formed by the container or package, and to discharge its contents into the beverage upon opening the package.

It is particularly desirable for the secondary chamber formed by the capsule to be filled with gas rather than with beverage, so that a jet of gas issues from the orifice upon release of the pressure in the primary chamber upon opening. It thus has to be ensured that any beverage which may enter the tube during distribution and storage does not impair the efficiency of the gas jet but is retained within the secondary chamber. To achieve this where the capsule is tubular in shape, the orifice is located and the tube is shaped along its length so that some regions of the tube are lower than the orifice to contain any beverage which is forced in, and that the orifice is in the lower side of the tube wall facing the base of the container so that there is little tendency for beverage to enter the tube during storage, due to the creation of the air lock which prevents gas and beverage interchange, aided by surface tension of the beverage across the small orifice.

The general shape of the tubular capsule is otherwise not critical to the operating principle and may be selected to achieve any preferred positioning and volume of the secondary chamber, to facilitate its insertion, and/or its retention within the primary chamber, which is typically a metal can.

The material of the capsule may be of any composition compatible with the beverage and selected for its mechanical properties and availability to suit the preferred handling system for manufacturing and placement into the beverage containers. The use of a composition resistent to the permeability of oxygen is advantageous.

A soluble or heat softening material may be employed to close the orifice and therefore prevent gas such as oxygen ingress through the orifice prior to beverage filling and prevent communication between primary and secondary chambers throughout some or all of the manufacturing process. By using a heat softening material, the temperature rise which occurs during pasturisation may be used to soften the material and open the orifice during the pasturisation phase. Where such a capsule has been fitted into the lower end of a can which has been filled with nitrogenated beer with a headspace above of nitrogen under pressure and the can his been inverted prior to pasturisation, as is commonplace in the art, the tube will have been transferred into the gaseous headspace within the can so that when the temperature sensitive material has melted, it is gas which enters the interior of the tube through the now open orifice to pressurise the tube to the same pressure as the headspace.

By maintaining the can in the inverted condition, whilst the contents are cooled during the second phase of the pasturisation process, any gas exchange arising from reducing pressure within the can will not cause beverage to be introduced into the capsule and when the can is subsequently turned to stand on its base, the air lock created by the design of the tube and the position of the orifice will ensure that the gas charge within the tube will be retained, to be available to form a jet of gas when the package is opened.

According to another aspect of the present invention a gas jetting device for fitting within a first beverage containing chamber which is to be sealed and pressurised in use and includes a base end on which it will normally stand upright, comprises a capsule defining a second chamber of smaller volume than the first chamber, which is adapted to be secured within the first chamber at a position such that it will be covered by beverage when the first chamber has been filled and is standing on its base, and which includes internal passage means which extends from just below an upper closed end of the capsule to an orifice in or just below the opposite lower end of the capsule, whereby the passage means communicates directly with any gaseous headspace within the upper end of the capsule above any beverage which may enter therein whereby when the first chamber pressure is reduced to atmospheric pressure as by opening it to dispense beverage therefrom, gas trapped in the capsule headspace will be emitted through the orifice as a jet of fine bubles into the beverage to form or assist in the formation of a head thereon.

According to a preferred feature of this aspect of the invention, should any beverage enter the capsule via the orifice and passage means, while the chamber is upright and the capsule is immersed in the beverage, it will, as in the device of GB 1266351, flow down to the base of the capsule, and a considerable depth of beverage can be accommodated within the capsule, before the level of the liquid reaches the upper end of the passage means leading to the orifice.

Where the first chamber is a generally cylindrical can (as will normally be the case) the capsule is preferably located substantially axially within the can.

According to a particularly preferred feature of the invention, the upper end of the passage means remote from the orifice terminates on or near the axis of the first chamber so as to render the device insensitive to orientation of the can about its vertical axis. Thus unlike the device described in EP 520646A1, the package will function in the same way whatever the relative position of the capsule, and outlet at the top of the can, through which the contents are poured.

The orifice may be located centrally of the base of the capsule. Where the orifice is central and downwardly facing, one or more downwardly protruding fingers may be provided around the orifice to prevent the lower face of the capsule containing the orifice from coming into contact with the can base.

Alternatively the orifice may be displaced from the centre of the underside of the capsule so that in the event that the can includes a domed base (as is conventional), the orifice will not become closed off if the second chamber is pushed into contact with the can base.

It has also been noted that a laterally displaced or directed aperture has other advantages in that bubbles of gas leaving the orifice during the head formation process tend not to become entrapped below the base of the capsule.

In a preferred design the capsule has a generally cylindrical upper, and a generally conical lower region, and is fitted in the can with the apex of the cone pointing towards the base of the can. The orifice may be located in the conical surface at and if so is typically at a position intermediate the apex and rim defining the junction of the conical and the cylindrical regions of the capsule.

The passage means may be formed by a free standing tube extending upwardly within the interior of the main body of the chamber from an orifice in the conical surface to an internal chimney like structure.

Alternatively the passage means may be formed at least in part within the wall thickness of the cylindrical section of the capsule or within a radially inwardly directed protrusion from the said wall.

In a symmetrical design of capsule the passage means in the capsule extends upwardly centrally of the interior of the capsule in a tube which extends from an orifice in the base thereof. Where the can into which the capsule is to be fitted is generally cylindrical in shape and the capsule itself is generally cylindrical in shape and the capsule is fitted into the can so as to be generally coaxial with the can, the tube is preferably co-axial with the capsule so that it is coincident with the axis of the can, and symmetry about the can axis is preserved.

Porting and passages may be provided in the wall of the capsule to communicate between the lower end of the tube and an aperture which itself is not located at the lowermost point of the underside of the capsule. It will be appreciated that if the capsule is pushed down into a can, the lowest point of the capsule will come into contact with the internal surface of the base of the can, thereby restricting fluid flow into and out of the capsule.

In a preferred arrangement the lower end of the tube communicates with a hollow downwardly pointing protrusion situated centrally of the underside of the capsule, which protrusion is closed at its lower end and is provided with a small hole typically in the range 200 to 600 microns diameter in the wall thereof, through which fluid can pass into and out of the tube and therefore the capsule.

The small hole may be formed by a laser beam.

Where laser boring is employed, a short focus beam is preferably used so that the wall of the hollow protrusion on the opposite side thereof is not penetrated by the beam and only one hole is formed in the tube wall.

Alternatively two diametrically aligned holes may be formed in the hollow protrusion but in that case it may be necessary to form smaller diameter holes so that the overall hole size is substantially the same as that of the single hole otherwise employed.

Preferably the cylindrical capsule section is closed by a lid, which may be removable but in any case is a gas tight seal on the body.

According to another aspect of the invention, the capsule is supported within a ring of resiliently deformable material by means of at least two and preferably three or more spokes, each of which is longer than the radial distance between the internally supported capsule and the ring, so that each spoke extends non-radially therebetween.

Such a design readily allows for the outer ring to be deformed by squeezing opposite regions thereof ring towards the central capsule. By doing so the overall diameter of the device is reduced in the direction of squeezing which enables the device to be inserted into a can having a neck which is smaller in diameter than the remainder of the can interior.

By supporting the device to be inserted at an angle relative to the axis of the can, the can may be lowered (or raise) over the inclined and a simple rotation of the can through an appropriate angle will bring the device into a plane which is generally orthogonal to the can axis, and in which the ring will grip the interior of the can.

The capsule is preferably formed from two parts, a first comprising a ring, non-radial spokes supporting within the ring a generally cylindrical housing having a conical or frusto-conical base with the axis of the cylindrical housing being substantially co-axial with the axis of the ring, and a lid adapted to be fitted to the upper end of the cylindrical part of the housing and sealed thereto.

Preferably a snap fit is provided and where the material from which the parts are made is resilient, grooves and complementary ridges may be provided in the two parts so that when they are snap fitted together, a good gas tight seal is immediately formed between the two cooperating members.

The capsule and bounding ring, supporting spokes, lid and passage means may be formed from plastics material, preferably food grade plastics material. PTFE may be used.

Ideally the capsule wall and lid material are impervious to gas So that there is little chance of gas loss from the capsule due to permeability there-through.

It will be appreciated that although the system is substantially in equilibrium, there will be slight hydrostatic pressure on the gas in the capsule and since the interior of the latter communicates with the beverage within the can via the orifice, any migration of gas through the wall or lid of the capsule will tend to be balanced by an ingress of beverage through the orifice so reducing the volume of gas trapped in the capsule.

The invention also resides in a beverage can when fitted with a capsule as aforesaid.

The invention also resides in a can and capsule combination as aforesaid when filled with a beverage and sealed and pressurised by the addition of gas in liquid form before sealing.

A further advantage of a can fitted with a capsule having an internal upstanding passage leading from an orifice as described, is that if the capsule is located near one end thereof so that the orifice can be brought into direct communcation with the gaseous headspace within the can by suitably upending the can in manner known per se, should beverage ingress, the capsule can in fact be substantially emptied of unwanted beverage by subjecting the pressurised can to temperature and pressure cycling whilst the capsule orifice communicates with the gaseous headspace. Such temperature and pressure cycling does not have to be carried out at the same time as pasturisation or immediately after filling and sealing but can be performed at any time provided the can is intact.

The invention therefore also comprises a method of removing unwanted beverage from a capsule located within a sealed and pressurised container at least partly filled with unwanted liquid and having an internal upwardly directed passage means therewithin leading from a charging and discharging orifice, comprising the steps of inverting the container so that the orifice is now above the open end of the internal passage means in the capsule and is in direct communication with the gaseous headspace in the container, and the liquid in the capsule forms with the inverted end of the package means a liquid seal so that gas cannot leave the capsule and thereafter raising and lowering the temperature of the contents of the container so that liquid is driven out of the capsule via the orifice and is replaced by gas from the headspace in the container.

According to another aspect of the invention the upper wall of the capsule may be domed or otherwise formed with an elevated central region above the upper end of the internal tube so as to permit a larger volume of gas to be trapped above the upper end of the tube than would otherwise be the case.

According to another aspect of the invention there is provided a capsule for insertion in a can which is to be partially filled with beer and pressurised with an inert gas, wherein the capsule may include residual oxygen and includes venting means through which gas trapped in the capsule under pressure can exit as a stream of bubbles for head production when the can is opened, and through which beer may flow into the interior of the capsule during temperature cycling, and the capsule may be provided with a well in the capsule interior to accommodate any ingress of beer and a liquid lock in the venting means such that following pasturisation a small quantity of beer is left within the venting means as well as in the capsule well, so that the gaseous contents of the capsule are separated from the beverage in the can by a liquid seal formed by the liquid trapped in the liquid lock.

The small quantity of beer in the venting means will inevitably precede the gas when the can is opened but by arranging that the volume of the beer forming the liquid seal is very small (typically less than 0.25 ml), its presence in the beer dispensed from the can will not affect the head producing gas emission. In any event it will be no greater in volume than the volume within the side tube of the original design of gas emitting device described in GB 1266351.

The venting means typically comprises a small hole in the capsule wall, passage means within the capsule which communicates between the small hole and terminates in a generally upper region within the capsule interior, preferably generally centrally of the capsule, so that if the capsule is tilted, any beer (typically in the range 2 to 20 ml) trapped in the well in the lower part of the capsule can swill around the interior of the capsule but will never cover the upper end of, or enter, the tube during normal tipping of the can.

Where the capsule is secured near the base of the can and the capsule is charged with pressurised gas from the headspace within the sealed can by the known can inversion step which normally precedes pasturisation, the aperture of the venting means is conveniently located within the base region of the capsule.

As already discussed, the invention provides for the fitting of a hollow capsule (typically of plastics material) at the bottom of a so-called two piece can before the can is filled with beverage and pressurised by the addition of nitrogen typically in the form of liquid nitrogen just before the can is sealed. To facilitate the pressurisation of the capsule the latter includes a small hole in its wall in a region thereof which will normally point downwards towards the base of the can. The small hole not only allows gas but also allows beer to enter the capsule, but by virtue of the invention and the provision of an internal upstanding pipe forming a liquid lock, only gas can jet therefrom when the can is broached and the interior of the can is suddenly reduced to atmospheric pressure.

By inverting the can shortly after seaming whilst the liquid nitrogen is still evaporating, as is common on conventional canning lines the gaseous headspace at the upper end of the can will be transferred to the upended base of the can and if the capsule is secured near the bottom of the can, the capsule will now be surrounded by gas instead of liquid so that the increasing can pressure will drive gas into the capsule instead of beverage. In the prior art devices as described in EP 227213 and GB 2211813, this technique enabled gas to be jetted (as opposed to beverage). Unfortunately the simple inversion step suffers from the disadvantage that the quantity of beverage which will be driven into the capsule before inversion occurs is dependent upon factors at least one of which is very difficult to control. This is the pressure/time profile within the can caused by the rise in pressure as the liquid nitrogen content of the can evaporates. Clearly this will depend upon the quantity of liquid nitrogen present. However in practice it is very difficult to meter liquid nitrogen into the cans at normal canning line speeds with sufficient accuracy to ensure that the pressure/time profile immediately after seaming is identical for each can. Since the cans all have to be turned over at the same point in time relative to the seamer, the variableness in the pressure/time profile from one can to another will result in different volumes of beverage being forced into the capsule, and therefore different volumes of beverage left in the can available for the consumer.

In the case of soft drinks the problem is of little consequence since by overfilling the can, the consumer will always be guaranteed a minimum volume. However where duty is to be paid on the contents of the can, any variableness in the retained volume of beverage will create uncertainty, and in general duty will be levied in such a way as to cover the worst case.

The provision of an internal upstanding tube in the capsule to act as a liquid trap and prevent beverage trapped in the capsule from leaving the capsule at least in advance of the gas charge trapped therein, does not necessarily prevent variation in the proportion of liquid to gas in the capsule when the latter is charged by can inversion.

However according to a further aspect of the present invention in a can fitted with a hollow capsule as aforesaid which includes a gas-liquid trap internally thereof, the capsule may be positioned generally midway up the can, so that when the can is inverted the aperture in the capsule remains submerged in the beverage at all times so that the capsule will only ever be charged by the entry of liquid forced in by the increasing can pressure, even when the can is inverted in the pasturiser and/or is upright and thermally cycled as between refrigerator and ambient temperature during storage.

The presence of the liquid lock means that any excess liquid forced into the capsule as the can pressure rises due for example to increase in temperature as during pasturisation will be driven out of the capsule as the internal pressure drops so as to maintain equilibrium but the gas charge will remain intact. The submersion of the capsule will mean that the proportion of liquid to gas which is established in the capsule during the initial pressurisation of the can contents, will be maintained, and will only alter very marginally depending on the actual temperature of the can when it is opened. The only disadvantage of the process is that a relatively large volume of beverage will be forced into the capsule in order to obtain equilibrium since if the capsule orifice never communicates with the gaseous headspace in the can there will be no possibility to charge the capsule interior preferentially with gas instead of beverage. However since the volume of beverage within the capsule will be substantially predictable and constant irrespective of the actual can pressure and actual time of inversion on the canning line, the contents which can be dispensed by the consumer are thereby limited to the volume of beverage within the can, reduced by that trapped in the capsule. Since the latter cannot be obtained by the consumer, any duty calculation can be computed on the basis of the beverage actually available to the consumer, and the saving in duty payable may be greater than the cost of the beverage lost in the capsule.

Since the volume of beverage within the capsule is an undesirable loss, even if it can be quantified so as to mitigate duty payable, it is nevertheless preferable to exclude as much beverage as possible from the capsule interior.

According therefore to a further preferred feature of the invention, the capsule may include valve means which is responsive to external pressure acting on the capsule so as to close off entry into the capsule via the orifice as soon as the capsule experiences a positive pressure acting from the outside thereof, to prevent ingress of beverage.

This feature can be used to advantage in a conventional canning line if the capsule is inserted into the can before filling since the initial step of filling a can with beverage is to pressurise the interior of the can with a non-oxidising gas such as nitrogen. This initial pressurisation step can be used to close off the interior of the capsule from the ingress of gas or any other fluid as soon as internal pressurisation of the can occurs.

A capsule of this type may be formed from, or include in at last part of its wall, a material which has a predictable permeability to gases such as are dissolved in the beverage such as carbon dioxide and nitrogen. The wall of the capsule will then act as a semi-permeable membrane and whilst a pressure differential exists thereacross (as will be the case until the contents of the capsule are at the same pressure as the interior of the can) gases will in known manner permeate through the wall of the capsule thereby increasing the pressure of the capsule interior. Where carbon dioxide and nitrogen are dissolved in the beverage, both of these gases will permeate into the capsule interior until the internal pressure in the capsule is a little less than that within the can.

By arranging that the valve means will operate to open the orifice and establish communication between the interior of the capsule and the remainder of the can when the pressure differential as between outside and inside the capsule is less than a small positive pressure differential, so the interior of the capsule will once again communicate with the interior of the can and at that stage gas or beer (depending on where the capsule is situated in the can relative to the headspace) will enter the capsule to equilibriate the pressure within and without the capsule.

By placing the capsule generally midway up the can, it is beverage which will enter the capsule when the valve means opens so that the effect can be standardised as between one can and another by including a liquid trap within the capsule in the form of an upstanding tube communicating between an upper region of the capsule and a lower orifice, so any beverage entering the capsule at that stage will be prevented from interfering with the jet of gas leaving the capsule when the can is finally broached for dispensing the contents.

The invention thus enables a capsule to be constructed which after the contents of the can and capsule have come into equilibrium, will essentially contain gas at the can pressure and a very small quantity of beverage which cannot be discharged from the capsule because of the gas-liquid lock formed therewithin, and which is therefore available to jet gas into the contents of the can when the can is opened, and its contents are reduced to atmospheric pressure.

Preferably a capsule in accordance with this last feature of the invention includes a downwardly protruding leg which at least in part is hollow and communicates with the upstanding pipe within the capsule forming the liquid lock therein and the wall of the hollow protruding leg is apertured to provide the jetting aperture through which gas will be jetted when the can is opened and the lower region of the protrusion provides a stop which prevents the capsule from being pushed further into the can than is desired. This is particularly important where the capsule is to be fitted so as to occupy approximately the halfway position within the can so that it never makes direct communication with the headspace.

The invention also lies in a can when fitted with any one of the capsules described in the foregoing, ready to receive beverage.

The invention also lies in a sealed package comprising a container having fitted therein a capsule such as described in the foregoing and a charge of beverage with a headspace above the beverage in the container containing a non-oxidising gas at a pressure greater than atmospheric.

The invention also lies in a method of fitting a capsule into a can which is subsequently to be filled with a beverage to a level above the height of the capsule wherein the capsule is to be situated at a prescribed height within the can and wherein the capsule includes at least a downwardly protruding leg and the method involves selecting the length of the leg to correspond to the prescribed height of the capsule within the can, and the method of locating the capsule within the can at the desired height involves pushing the capsule axially into the can until the lower end of the leg engages the base of the can.

The invention also lies in the method of inserting a capsule as aforesaid into a generally cylindrical can having a reduced diameter entrance neck region, wherein the capsule comprises a central chamber for containing gas and a bounding ring which is a close fit within the larger internal diameter of the can and which is supported by non-radial spokes extending between the chamber and the ring and is resiliently deformable so as to define an oval shape to enable the capsule to be inserted through the reduced diameter neck of the can whereafter the can can be twisted relative to the capsule so that the latter becomes co-axial with the can to retain the capsule in the desired position within the can.

DESCRIPTION OF THE DRAWINGS

Examples of capsules for, and can and capsule combinations for, packaged beverages are shown in the accompanying drawings.

In the drawings.

In the embodiments shown in FIGS. 1 to 5, the secondary chamber for location within the beverage package (typically a can) comprises a length of tube 10 having sealed ends 12 and a small orifice 14 intermediate its ends.

Figure 1:
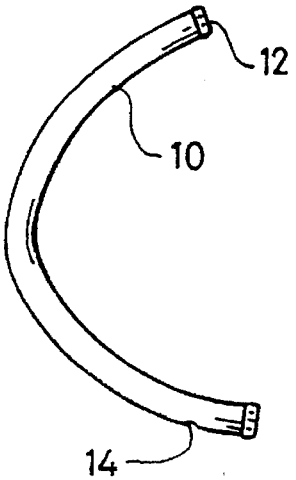
FIGS. 1 to 7 show various differently shaped tubular secondary chamber devices which can be located within a can such as shown in FIGS. 2 and 7.
Figure 2:
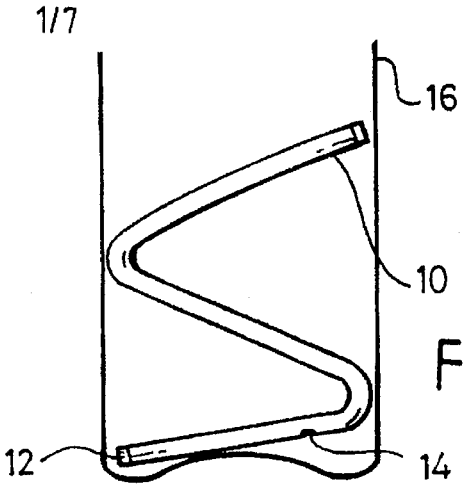
Figure 3:
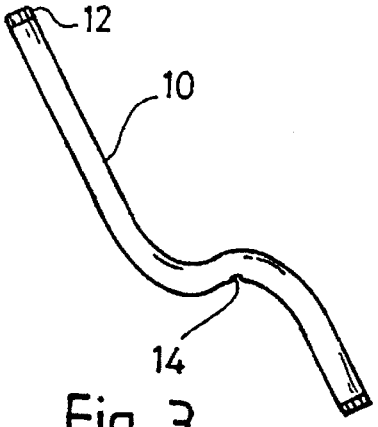

The tube is shaped to retain its location and orientation when immersed in the beverage within the can, with the orifice 14 on the underside, as exemplified by FIG. 2 wherein reference 16 denotes the can.

The tubular secondary chamber is pressurised with gas, eg nitrogen, or with beverage.

The tube may be filled with a non-oxidising gas such as nitrogen prior to insertion in the package.

Alternatively it may be filled by adding nitrogen to the package (bottle or can) prior to filling (known per se), and/or after filling and before closure (again known per se), and ensuring by the position of the orifice that essentially gas only enters the tube through the orifice on pressurisation following closure, using the fact that cans are inverted before pasturisation on conventional canning lines. The orifice is sufficiently small that, having regard to its position, exchange of liquid between the primary and secondary chambers is substantially prevented under the sealed and pressurised condition existing within the package prior to opening.

The secondary chamber may contain an absorbent material to inhibit emission of any:beverage (which has somehow seeped into the tube) on discharge of gas from the orifice, when the package is opened to atmospheric pressure.

When the sealed package is opened, the then existing overpressure in the secondary chamber causes a jet of gas to be released into the beverage through the orifice, producing a rich head on the beverage which is apparent as the beverage is poured into a glass for consumption.

A preferred volume for the tube is between 1 and 20 cc, preferrably 3 to 15 cc, whilst a preferred orifice size is 0.1 to 0.6 mm, preferrably 0.1 to 0.4 mm, in a tube of diameter between 1 and 10 mm, preferrably 2 and 6 mm.

It should be emphasised that if only gas is to issue from the orifice, as is preferred, then the tube shape and orifice location are important to minimise beverage ingress and prevent beverage emission when the package is opened. This can be achieved by locating the orifice near the bottom end of the tube, as in FIG. 1 for example, or by locating the orifice above lower, beverage retaining regions of the tube.

Where, as is conventional, the package is to be pressurised on filling, a small quantity of liquid nitrogen may be dropped into the package just before the package is sealed by the securing of a lid to the can.

Figure 4:
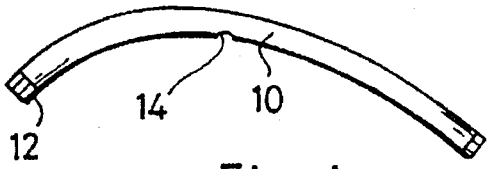
Figure 5:
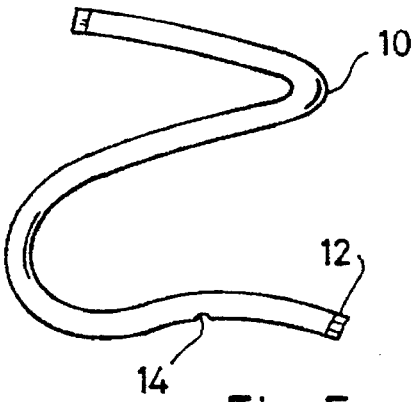

FIG. 4 shows a more symmetrical arrangement in which a length of tube 10 is closed at both ends 12 and is humped midway to define an elevated gas retaining region with the orifice 14 in the underside of the curved region so that when fitted into the base of a can the two ends of the tube engage diametrically opposite regions around the interior of the can to keep it in position and the orifice faces generally downwards towards the bottom of the can.

As the can is inverted (with the tube in position), as it passes along a conventional canning line the headspace in the can transfers to the end containing the tube and gas from the headspace can enter the tube and will remain trapped in the tube even when the can is turned back to stand on its base, to be available for jetting through the orifice when the can is opened to atmospheric pressure.

The expansion produced as the liquid nitrogen is warmed up to ambient temperature and converted to gas, pressurizes the interior of the package up to as high as 6 atmospheres, although normally a pressure of 2 to 4 atmospheres is obtained, and in any case has been found to be sufficient.

Figure 6:
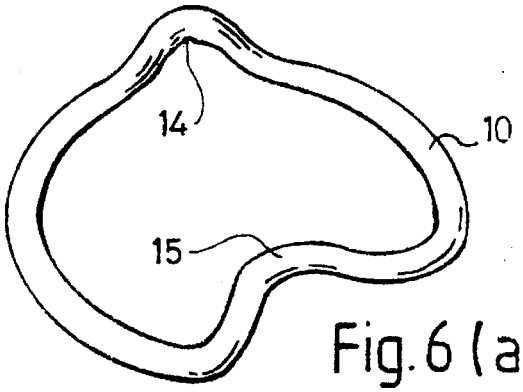
Figure 6B:
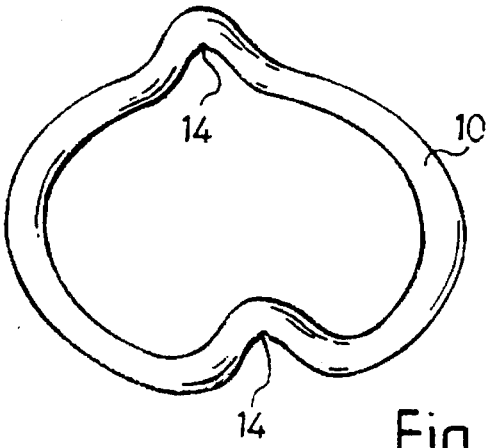
Figure 7:
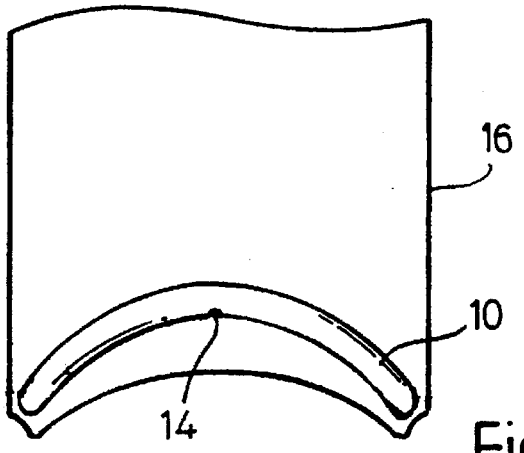

FIGS. 6 and 7 show a development of the basic device which may be more suited to being secured at the base of a standard cylindrical drinks can. The tube 10 is now formed in a continuous loop the circumferential extent of which is greater than the internal circumference of a standard drink can. The tube is preformed with the humped section containing the orifice 14 shown in FIG. 6(*a*) so that the gas-jetting orifice 14 is located in a section of the tube wall which will face the base of the can when installed. When the loop, even with the preformed humped region containing the orifice 14 is still too large to fit into a can, another region of the tube, must be deformed inwardly from its normal curved condition (as shown at 15 in FIG. 6(*a*)) to permit the remainder of the loop to fit within the bottom of the can, as shown in FIG. 7, the region containing the downwardly facing orifice 14 the highest point around the circumference of the tube, the section of tube immediately above the orifice comprising a gas entrapment region. Any beverage which enters the tube will flow down into, and occupy the lower regions of the tube.

If desired a fully symmetrical device may be formed such as shown in FIG. 6(*b*), in which the loop 10 is kinked upwardly in two circularly spaced apart regions around its length, and in each hump an orifice such as 14 is formed in the underside of the tube wall—each upwardly kinked region constituting a gas entrapment region, and the overall length of the ovaloid device being a little greater than the internal diameter of the can in which it is to be fitted, so as to ensure a good tight fit when pushed down to the bottom of the can, as shown in FIG. 7.

The combination shown in FIG. 7 is readily suited to use on a conventional canning line, without modification to the line, since the cans on such lines are rapidly inverted after filling and sealing so that the device 10 will now be in the gaseous headspace (which always occupies the upper end of the can whichever way up the can is standing), so that as the pressure in the can increases as the liquid nitrogen added during filling evaporates, so the tube 70 will become filled with gas at the same pressure, to remain trapped in the tube even when the can is turned to stand on its base, since the hole 14 faces downwardly when the can is standing on its base (as shown in FIG. 7) and there will be no tendency for the gas to escape—as might be the case if the hole were in the side or top of the tube.

The invention may also be applied to preformed (typically moulded plastics) capsules such as have been fitted to certain canned beers and stouts which conventionally are supplied in two piece spun aluminium cans in which the lid is seamed to the top of the can after filling.

Figure 8:
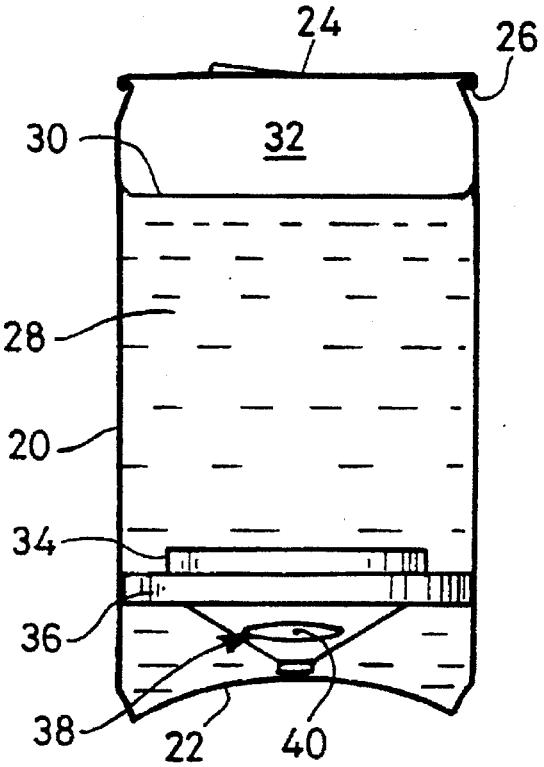
FIG. 8 is a diagrammatic view of a beer can partially filled with beer and containing a secondary chamber in accordance with the invention.
Figure 9:
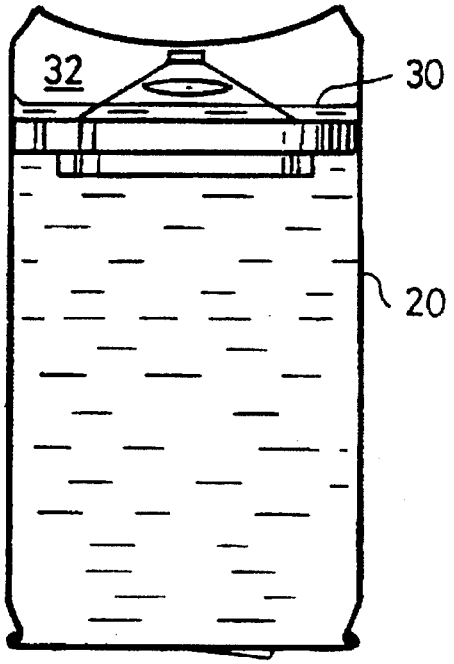
FIG. 9 shows the can of FIG. 1 inverted and indicates how the headspace transfers to the opposite end of the can and communicates with the interior of the secondary chamber.

In FIGS. 8 and 9 a spun aluminium can 20 having a domed base 22 and a cover 24 seamed thereto by a seam weld 26 is filled with beer or stout or other carbonated alcoholic beverage 28 to a level 30 leaving a head space 32 thereabove which contains gas. In known manner the upper head space is pressurised during the filling process for example by liquid nitrogen dosing so that when sealed, a pressure in excess of atmospheric pressure exists within the can typically of the order of 4 bar.

Situated and secured in position at the base of the can is a hollow insert 34 surrounded by a bounding ring 36 which is an interference fit within the can. The hollow insert is partly cylindrical and tapers in a conical form on its underside. A shoulder is formed within the conical surface at 38 within which is formed a very small orifice 40 which communicates with the interior of the insert in accordance with the invention in a manner which will be described later.

After sealing and before pasturisation the can is inverted so that the seam 26 can be checked for leaks as is commonplace on conventional canning lines.

During pasturisation the pressure in the can becomes greater due to the rise in temperature, and because the headspace 32 has now transferred to the other end of the can due to inversion, it is the headspace which is in communication with the interior of the insert 34 through the orifice 40 and not the liquid contents 28. During pasturisation the overpressure produced drives gas into the insert 34 to maintain a pressure balance and provided the can is left inverted for a reasonable period of time whilst the product cools (as is normal on conventional canning lines), the consequent reduction in pressure merely causes transfer of gas out of the insert which will otherwise remain largely filled with gas and not liquid. Once the can has been cooled to room temperature it can be rotated again to stand on its base 22 for packaging and storage.

Although the position of the insert will now be as shown in FIG. 8 once again, and is submerged below the liquid 28, there is little tendency for liquid to enter the insert 34, but even if any liquid does enter, provision is made in accordance with the invention to restrict and prevent the intruding liquid from interfering with the function of the device which is to jet gas on opening the package, to produce a froth head on the beverage as it is dispensed.

Figure 10:
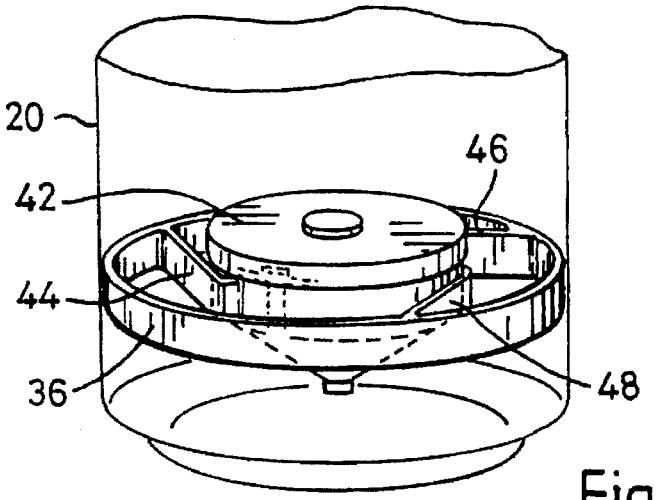
FIG. 10 is a perspective diagrammatic view of the secondary chamber fitted at the lower end of the can of FIG. 1.

FIG. 10 merely shows in more detail how the insert can be supported within the can at the lower end thereof and the same reference numerals have been used to denote the same parts as shown in the various drawings. The additional element shown in FIG. 10 is the lid 42 shown fitted to the upper end of the cylindrical section of the insert 34 and the non-radial spokes 44, 46 and 48 which support the insert within the bounding ring 36.

Figure 11A:
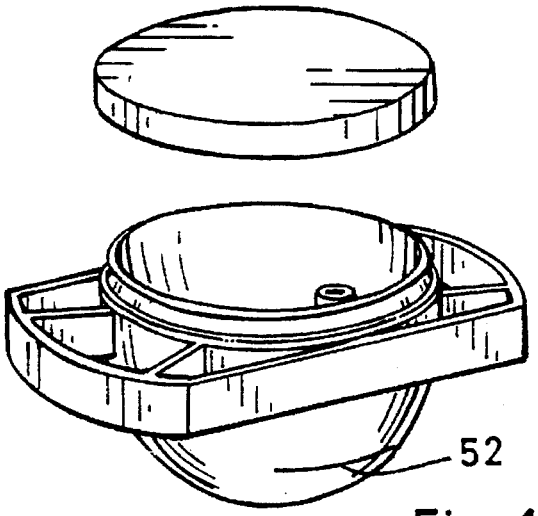
FIG. 11 is a perspective view of the underside of an alternative chamber in which the conical part of the housing is hemispherical.
Figure 11:
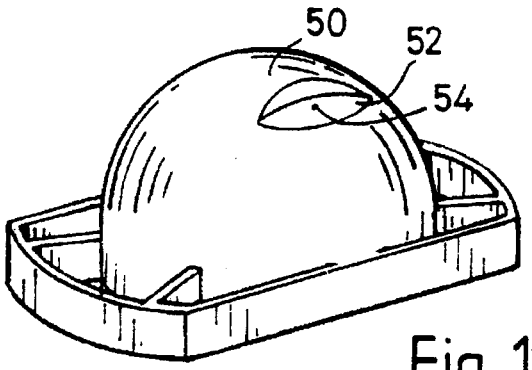

FIG. 11(*a*) and 11(*b*) illustrate an alternatively shaped insert in which the lower section is more hemispherical than conical, and a shoulder is formed by cutting away part of the surface of the domed wall 50 to define a shoulder 52 in which is located the orifice 54 (denoted as 40 in FIG. 8).

Although the external shape of the insert shown in FIG. 11 is different from that in FIGS. 8 and 9, it is to be understood that the formation of the shoulder and the provision of the orifice therein does not alter the function or operational characteristics of the device.

The other feature shown in FIG. 11 is the flexible nature of the bounding ring which is shown collapsed inwardly (as by squeezing) at two diametrically opposite regions to form a generally ovaloid shape to permit the structure to be inserted edgewise into the narrow neck of a can such as is shown in FIG. 8. Once inside the can, rotation of the can relative to the insert will enable the bounding ring to interferingly engage the interior surface of the can and wedge the insert in position, and/or allows the structure to be pushed axially down the can to its desired position therein.

Figure 12:
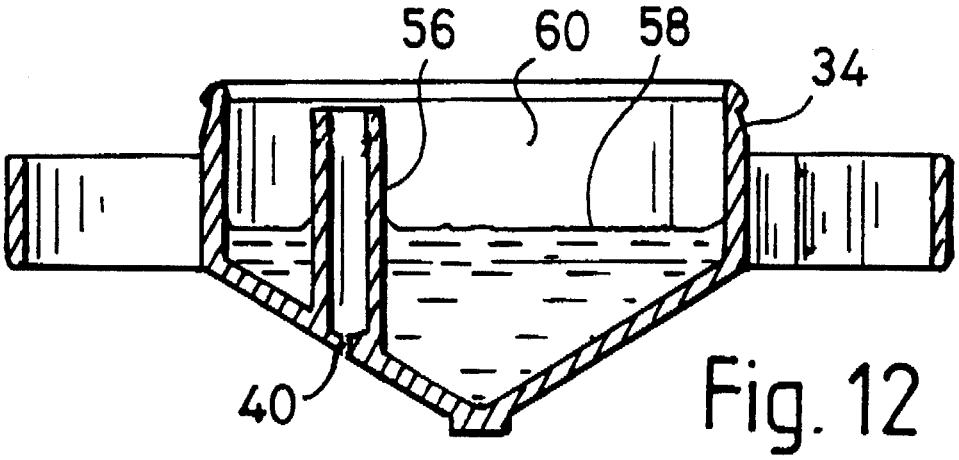
FIG. 12 is a cross-section through a preferred form of secondary chamber construction.

FIG. 12 is a cross-section which shows one position for the orifice 40 and in accordance with the invention the provision of an upstanding standpipe 56 which communicates between the interior of the insert and the orifice 40. Although it is not expected that much beer will ingress into the insert, for illustration a considerable quantity of beer is shown in the insert 34 and the surface is denoted by reference numeral 58. It will be seen that provided the standpipe extends near to the top of the chamber as shown, the can 20 may be tilted for in excess of the angle which the can would normally adopt when pouring therefrom, before there is any tendancy for the beer or other liquid in the device to cover the upper end of the standpipe 56 and thereby cause liquid to be ejected in preference to gas. The gas trapped in the head space 60 is thus free to exit through the pipe and orifice 40 when the can is depressurised as when broached before dispensing its contents, and a good foaming froth head is produced by the emission of a stream of bubbles from the orifice in known manner.

Figure 13:
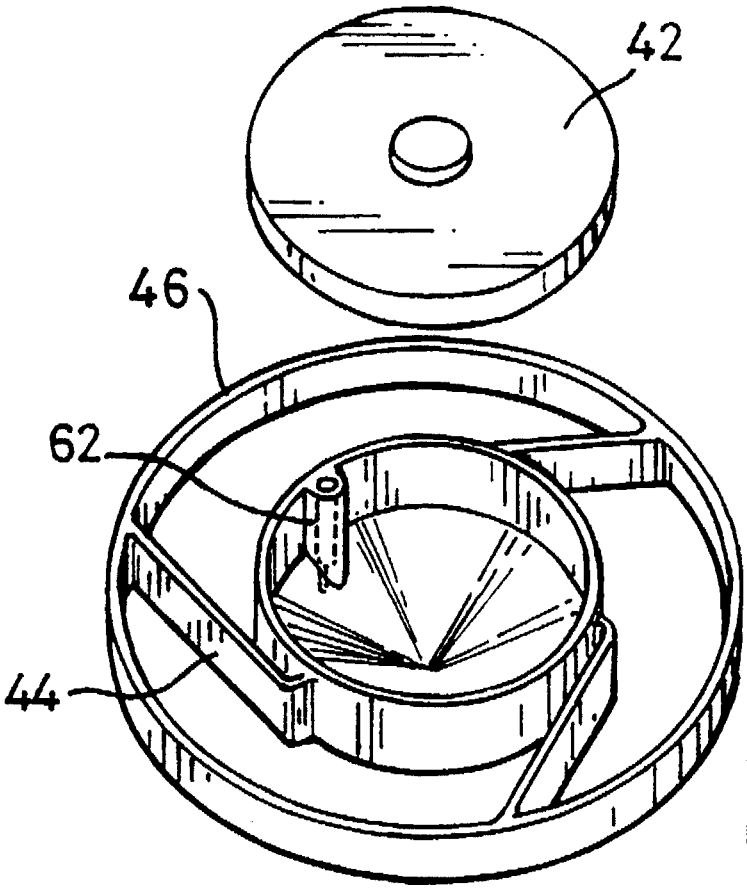
FIG. 13 is an exploded perspective view of the second chamber design shown in FIGS. 3 and 5 in which the passage means is integrally formed with the side wall of the chamber.
Figure 14:
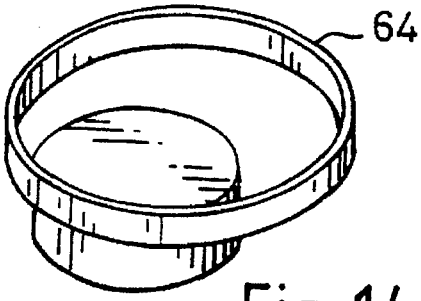
FIGS. 14 and 15 illustrate one form of distortable support ring.

An alternative position for the standpipe is shown at FIG. 13 in which a radially inwardly directed protrusion 62 accommodates the fluid passage. Although not shown in both arrangements of FIGS. 12 and 13, the upper end of the standpipe or passage can be extended laterally so as to communicate with the centre line of the insert if desired. The advantage of doing this is that the upper end of the passage 56, 62 is thereby located approximately on the centre line of the can 20, and thus renders the device substantially insensitive to can orientation when pouring. A disadvantage is that this increases the volume of the standpipe and in the event that liquid is trapped in the standpipe an increased volume of liquid has to be ejected from the standpipe before the gas can escape.

Figure 15:
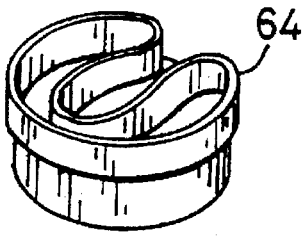

Alternative forms of bounding ring are shown in FIGS. 14 to 18. Thus in FIG. 14 the ring 64 is shown attached to one point around the circumference of the cylindrical section of the insert and preferably above the insert so that it can be completely folded in on itself as shown in FIG. 15 to allow the insert to be pushed through a very small opening, as for example the neck of a bottle.

Figure 16:
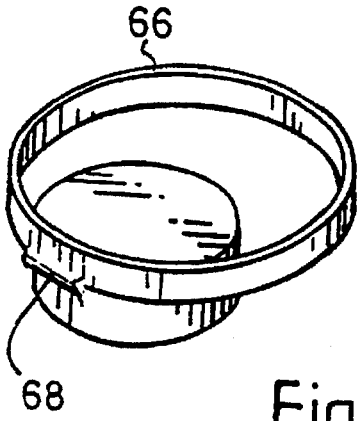
FIGS. 16 and 17 show a further type of support ring hinged to the second chamber.
Figure 17:
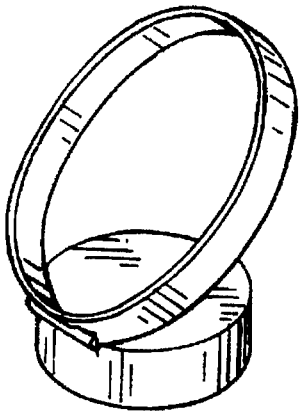

In FIGS. 16 and 17 the ring 66 is joined to the upper edge of the cylindrical section of the insert by means of a hinge 68 which may be a strip hinge formed of plastics material. The ring 66 is deformable as previously described so that it can be deformed to allow for entry of the arrangement through a narrow opening.

Figure 18:
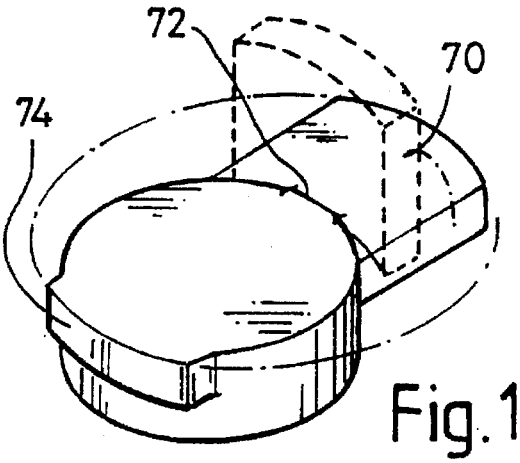
FIG. 18 shows a fold down wing for wedging the device within the can.

A somewhat similar arrangement is shown in FIG. 18 in which a flap or flange 70 is hinged to° part of the circumference of the cylindrical part of the insert opposite to a similar protruding flange or flap which may be of the same size or of reduced radial extent and may itself be hingeable. The hinge for the flap 70 is shown at 72. In its down position as shown in full line in FIG. 18, the flap 70 cooperates with the oppositely directed flap 74 protruding from the other side of the insert. As shown flap 74 is only a small protrusion from the cylindrical wall but as indicated above this could be a similar size to the flap 70 and can be either permanently extended or be hinged as by a second hinge (not shown).

Clearly by hinging upwardly the flap 70 (and if appropriate the other flap 74), the overall dimensions of the device will be significantly reduced.

The offset so introduced by the flanges of FIG. 18 or the arrangements shown in FIGS. 14 to 17, may be used in combination with an offset pipe 56 or 62 so as to place the latter nearer the centre line of the can.

Figure 19:
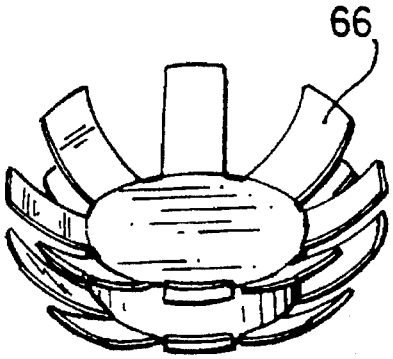
FIG. 19 illustrates a flexible petal design of securing means for holding the second chamber within the can.
Figure 20:
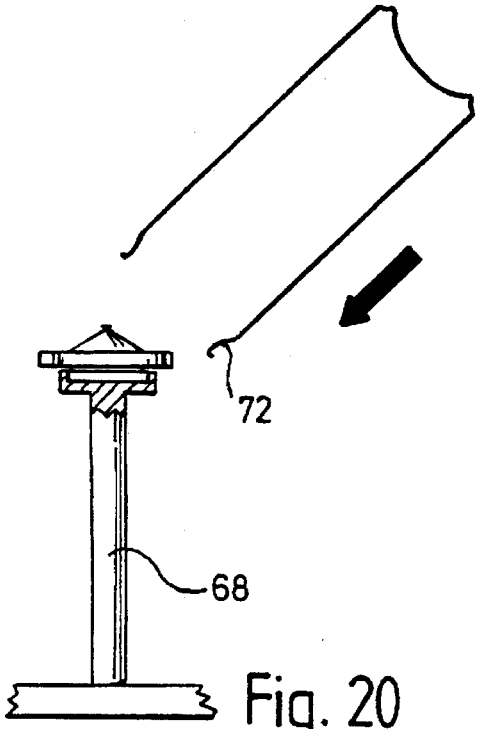
FIGS. 20 to 24 show how a capsule such as shown in any one of FIGS. 10 to 13 can be inserted into a can without the need for twisting the device within the can.

FIG. 19 shows a still further arrangement in which a plurality of petals or flexible fingers (one of which is designated 76) extend radially from the upper rim of the cylindrical section of the insert and the resilience and length of the fingers 76 are selected so as to ensure that the insert is held firmly within a circular cross-section can or bottle into which the device is inserted by cooperating engagement of the fingers and the inside wall of the can or bottle. By making the fingers sufficiently flexible, so the device can be pushed bodily through an opening which itself is of smaller diameter than the diameter of the section of the can within which the insert is to be secured in place.

Figure 21:
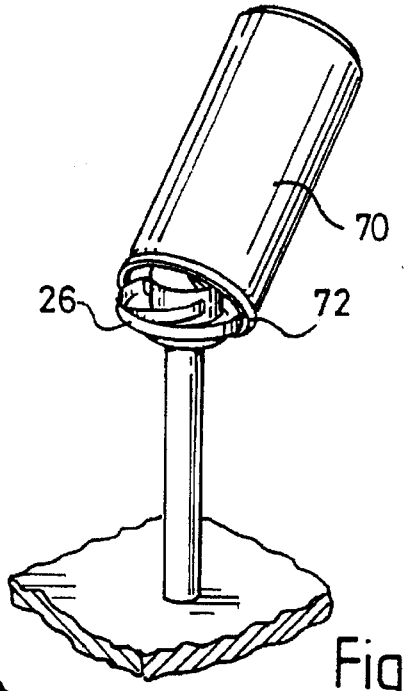

An advantage of all of the arrangements shown in FIGS. 14 to 19 is that if desired the insert can be pushed through the reduced cross-section area of the can or bottle without having to be tilted. This makes for a simpler mechanical handling device for positioning and inserting the insert into the cans or bottles.

Where the bounding ring is such as shown in FIGS. 10 and 13, the insert cannot be so easily inserted into a can having a reduced diameter neck, and FIGS. 20 to 24 show a preferred method by which such an insert can in fact be located within a can. To begin with, the insert is located on an upstanding pedestal 78 with the conical or domed section of the insert pointing upwards. As shown in FIG. 21, the can 80 is then lowered at an angle over the insert and because the bounding ring 36 is presented to the can at a relatively sharp angle, the reduced diameter neck region of the can 80 will tend to squeeze the ring inwardly and deform the ring to enable it to enter through the reduced diameter section of the can.

Once beyond the neck denoted by 82, the angle of the can 80 to the support 78 is maintained substantially constant whilst the can is lowered, thereby presenting an effectively larger area to the ring 36 than would be the case if the can were aligned with the axis of the support 78 before it is lowered.

Figure 22:
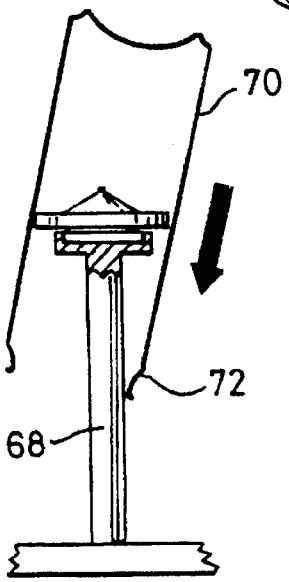
Figure 23:
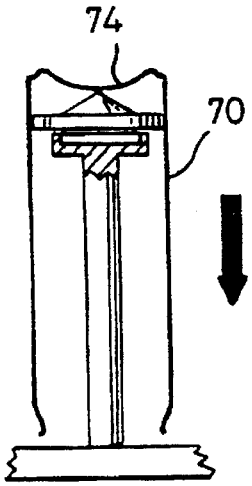

This is shown in FIG. 22.

Once the insert has been pushed into contact with the domed end of the can 84, the can 80 can be tilted into alignment with the axis of the support 78. The insert will now be in the correct position and alignment within the can.

Figure 24:
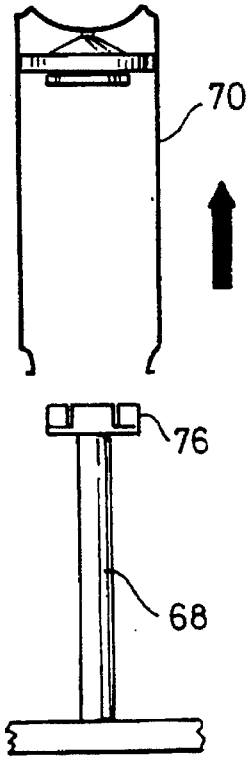

By providing a releasable gripping device 86 at the upper end of the support 78, the insert can be released by operation of the release mechanism 86 enabling the can together with the insert positioned therein to be withdrawn off the support 78 in an upward direction as shown in FIG. 24. The support is now ready for another insert to be positioned thereon and a further can lowered thereover in a similar manner to that illustrated in FIGS. 20 to 23.

It is of course necessary for the head 86 of the support to have a diameter which is a clearance fit or better within the reduced diameter neck region 82 of the can 80.

A further advantage of a can fitted with an insert as described herein is that should beverage ingress, the insert can be in fact substantially emptied of unwanted beverage by subjecting the pressurised and filled can or bottle to temperature cycles whilst in an inverted position, so that the insert communicates with the gaseous head space. Such temperature and pressure cycling does not have to be carried out at the same time as pasturisation or immediately after filling and seaming but can be performed at any time provided the can is intact.

Figure 25:
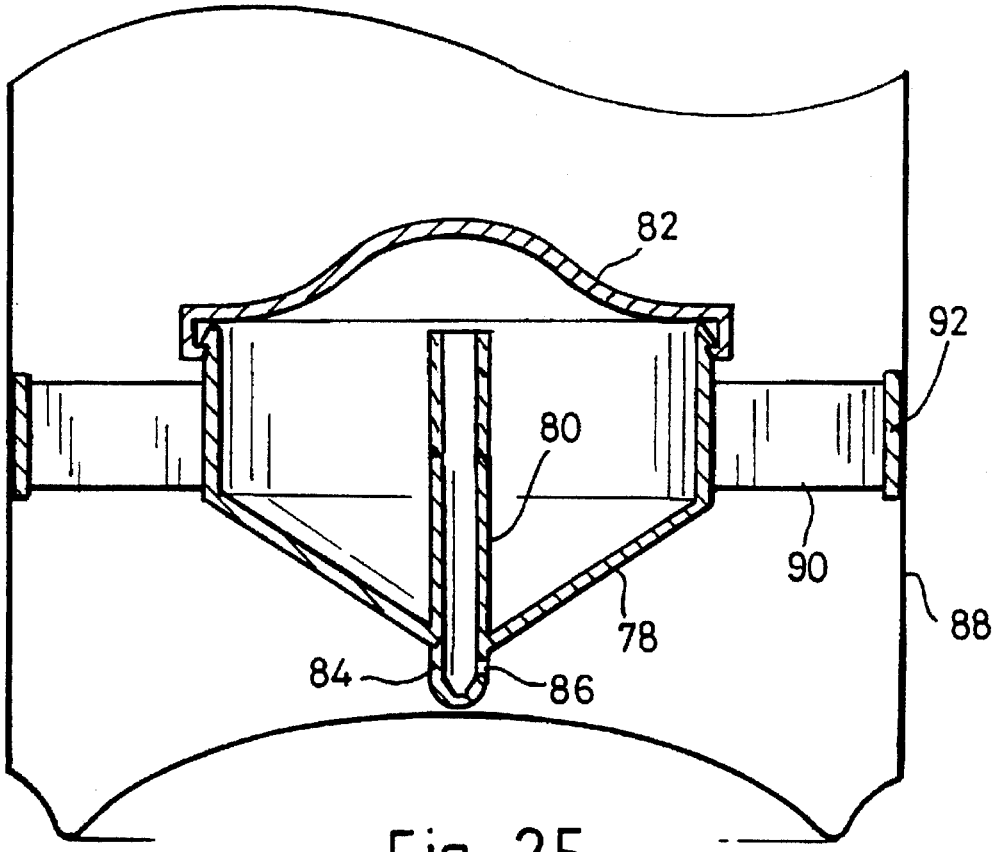
FIG. 25 is a cross-sectional view through the lower end of a can containing a particularly preferred form of capsule embodying the invention.

A preferred form of capsule construction is shown in FIG. 25. FIG. 25.

The capsule is denoted by reference numeral 78, the standpipe by 80, the lid by 82, the downwardly projecting protrusion 84 and the orifice at 86. FIG. 25.

The capsule is shown fitted in a can 88 by fingers or spokes 90 and a bounding ring 92 which engages the interior of the can and holds the device in position at the bottom of the can with the spigot 84 touching the domed base of the can. The spokes may be as shown in FIGS. 10 to 13.

The capsule operates substantially as described in relation to FIGS. 8 to 13 except that the gas jetting from the device now leaves substantially horizontally and thus creates a good swirling action in the can.

The domed lid 84 is optional, but if provided enables a larger volume of gas to be trapped above the standpipe 80 even if the capsule becomes filled with beer to the level of the latter, as may happen if the can is not turned over for a long time after the can has been pressurised during the canning process. This makes the position and therefore timing of the twist to invert the cans as is provided on conventional canning lines, less critical, and may allow lines to be used without modification since although some canning lines have the post filling twist positioned so that the cans are inverted within 3 seconds of filling, others do not do so until some 10 seconds or more after filling.

If the sealed can is thermally cycled as between normal house temperature and the temperature of a domestic refrigerator, with the can in its normal upright position, there may be a further liquid-gas exchange such that more liquid is left in the capsule.

Since any liquid trapped in the capsule reduces the volume of the capsule available for gas and since it is the latter which creates the desirable froth head, it is advantageous if the quantity of beer entering the capsule is constant so that a consistent head producing effect is obtained.

The provision of an internal passage or standpipe in the capsule to act as a liquid trap, prevents any beverage trapped in the capsule from leaving it. However these devices do not prevent a variation in the proportions of liquid to gas in the pod when the latter is charged at least in part by gas, due to the inversion of the cans on the filling line.

Figure 26:
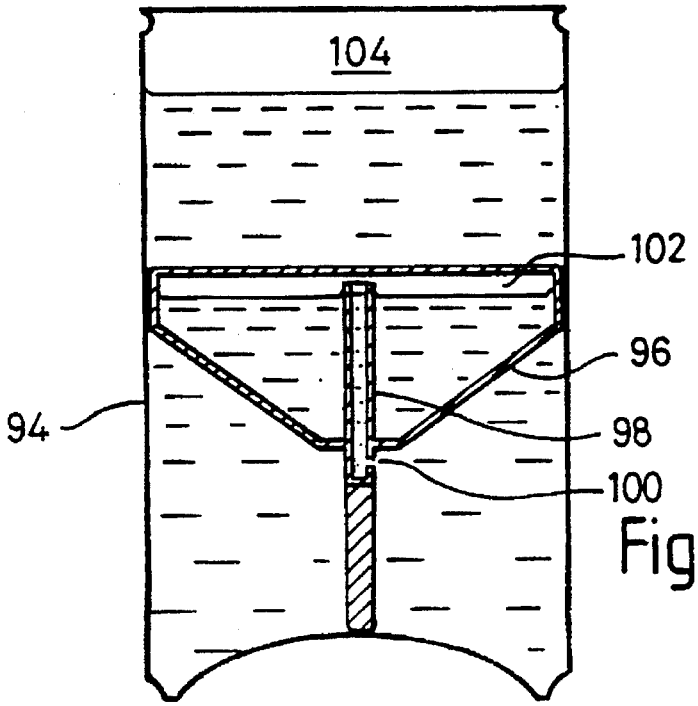
FIG. 26 shows in cross-section a can containing an alternative capsule adapted for positioning midway down the can so that it remains submerged below the beverage in the can whether the can is upright of inverted.

FIG. 26 shows an arrangement by which it is possible for cans to be upturned after filling, so that the top seam can be checked (in known manner) for leaks after pasturisation, and which nevertheless permits the capsule device to be pressurised consistently.

Thus a can 94 fitted with a hollow capsule 96 as aforesaid, includes a liquid trap in the form of pipe 98 internally thereof. The capsule is shown positioned generally in the middle of the can so that even when the can is inverted the gas jetting aperture remains submerged below the beverage. In this way, the capsule will only ever be pressurised by the entry of liquid forced in by the increasing can pressure, whether the can is inverted (as in the pasturiser) or is upright and being thermally cycled as between refrigerator and ambient temperature.

The capsule will fill until the internal gaseous headspace 102 (in the capsule) is at the same pressure as the contents of the can, which will therefore be equal to the pressure in the headspace 104 in the can 94.

The liquid trap formed by pipe 98, ensures that any excess liquid entering the pod (as during pasturisation) will flow out of the capsule as the internal can pressure drops, so as to maintain equilibrium.

The gas will remain trapped in the headspace 102. The continued submersion of the capsule will mean that whatever the proportions of liquid to gas established in the capsule during the initial pressurisation of the can, those proportions will be maintained and will merely alter slightly depending on the actual temperature of the can. Since in general canned beer is usually poured chilled as from a domestic refrigerator, this will mean the cans will normally be dispensed at or near the same temperature.

The only disadvantage of this process is that a relatively large volume of beverage will be forced into the capsule in order to obtain equilibrium since if the capsule never communicates with a gas space in the can there will be no possibility to partially charge the capsule interior with gas instead of beverage.

This can be overcome if the capsule includes valve means to close off fluid entry into the capsule as soon as the interior of the can begins to increase in pressure. This can for example be arranged to occur as soon as the can is attached to the filler since before any liquid is forced into the can from the filler, the can is purged and pressurised with an inert gas (usually nitrogen). By forming at least part of the pod from a material which has a predictable permeability to gases dissolved in the beverage such as Carbon Dioxide and Nitrogen, so the permeation of the gases into the interior of the capsule causes the internal pressure in the capsule to rise, until its internal pressure is a little less than that within the can and the valve means can open, and gas or beer (depending on where the capsule is situated in the can) will enter the capsule to equilibriate the pressures.

By placing the capsule generally in the middle of the can, only beverage will enter the capsule when the valve means opens, so that the effect can be standardised as between one can and another, and by including a liquid trap within the capsule so any beverage entering the capsule at this stage will be prevented from interfering with the jet of gas leaving the capsule when the can is finally broached before pouring.

We claim:

1. A gas jetting device for fitting within a first beverage containing chamber which is to be sealed and pressurized in use and includes a base end on which it will normally stand upright, comprising a capsule defining a second chamber of smaller volume than the first chamber, which is adapted to be secured within the first chamber at a position such that it will be wholly covered by a beverage when the first chamber has been filled and is standing on its base, an orifice permitting communication between the first and second chambers and through which gas trapped in the upper end of the capsule will be emitted as a jet of fine bubbles into the beverage to form or assist in the formation of a head thereon, when the first chamber pressure is reduced to atmospheric pressure as by opening it to dispense beverage therefrom, wherein the capsule is secured within the first chamber such that when the first chamber is upright:

(1) the orifice is situated in the region of a lower end of said second chamber, and (2) internal passage means extends downwardly from just below an upper closed end of the second chamber to the said orifice so as to communicate the orifice directly with said upper end of the second chamber and any gas above any beverage which may have entered the second chamber.

2. A device as claimed in claim 1, wherein the lower end of the capsule defines a well into which beverage can flow in the event that beverage is forced up the passage means, the lower end of the capsule being adapted to retain and accommodate a depth of beverage before the level of the beverage reaches the upper end of the passage means leading to the orifice.

3. A device as claimed in claim 1, wherein the first chamber is a cylindrical can and the capsule is also cylindrical and is located coaxially in the can, and the upper end of the passage means remote from the orifice terminates on or near the axis of the first chamber so as to render the device insensitive to orientation of the first chamber about its vertical axis.

4. A device as claimed in claim 1, wherein the capsule includes a cylindrical region and the orifice is laterally directed so as to discharge bubbles in a direction away from the axis of the cylindrical region of the capsule.

5. A device as claimed in claim 4, wherein the orifice is located centrally of the base of the capsule.

6. A device as claimed in claim 1, wherein the capsule has a generally cylindrical upper region and a generally conical lower region and is fitted in the can with the apex of the cone pointing towards the base of the can.

7. A device as claimed in claim 5, wherein the capsule includes a generally cylindrical region and the passage means is formed by a tube extending upwardly within the interior of the capsule from the orifice to form an an internal chimney structure.

8. A device as claimed in claim 7, wherein the tube extends axially within said interior of the capsule so that the latter is symmetrically arranged around said tube.

9. A device as claimed in claim 1, wherein the passage means is formed at least in part within the wall thickness of a generally cylindrical region of the capsule.

10. A device as claimed in claim 1, wherein the lower end of the passage means communicates with a hollow downwardly pointing protrusion situated centrally of the capsule, which protrusion is closed at its lower end and is provided with a small hole in its wall thereof through which fluid can pass into and out of the passage means and therefore the capsule.

11. A device as claimed in claim 1, wherein the capsule is circular in plan view and is supported centrally within a generally circular ring of resiliently deformable material by means of at least two spokes each of which is longer than the distance measured in a radial sense between the internally centrally supported capsule and the generally cylindrical ring, so that each spoke extends non-radially therebetween and the outer ring to be readily deformable by squeezing diametrically opposite regions thereof.

12. A device as claimed in claim 11, wherein the ring is reduced in diameter temporarily to enable the device to pass through a circular open end of a can the diameter of the open end of which is less than the diameter of the ring.

13. A device as claimed in claims 1, wherein the capsule includes an upper wall which is domed or otherwise formed with an elevated central region and the passage means extends from just below said elevated central region.

14. A device as claimed in claim 1, wherein valve means responsive to external pressure acting on the capsule to close off entry into the capsule via the orifice as soon as the capsule experiences a positive pressure acting from the outside and time or temperature responsive means is provided for permitting ingress of gas to tend to equalize the pressure in the capsule and the can until the pressure differential is insufficient to maintain the valve means closed whereafter the capsule can be charged with gas from the gaseous headspace within the can to achieve final equalization of pressures.

15. A device as claimed in claim 14 fitted within an empty beverage can.

16. A device as claimed in claim 14, wherein at least part of the capsule is formed from a material having a predictable and known permeability to gases such as nitrogen and carbon dioxide so that the capsule wall or lid acts as a semi-permeable membrane so that whilst a pressure differential exists thereacross gas will in known manner permeate through the wall or lid of the capsule so as to pressure the interior thereof.

17. A device as claimed in claim 14, wherein the valve means is an imperfect closure so that there is a flow of fluid through the closed valve means which eventually causes the internal pressure within the capsule to rise sufficiently to cause the valve means to become fully opened and admit gas from the headspace.

18. A device as claimed in claim 14, which is fitted in a can to be processed along a canning line which includes a pasteurization step prior to which the cans are inverted for leak detection and the time or temperature dependent valve operating means is adapted to release the valve means and open the capsule after the can has been inverted and the capsule orifice is in direct communication with the gaseous headspace rather than the beverage.

19. A device as claimed in claim 1, which is fitted midway up a can and which includes an upstanding pipe within the capsule to form a liquid lock therein if the can is inverted and a downwardly protruding leg at least part of which is hollow and communicates with the upstanding pipe within the capsule and which is apertured to provide the gas jetting orifice through which gas will be jetted when the can is opened and through which fluid can pass to enter and pressurizes the capsule, the lower region of the downwardly protruding leg providing a stop which prevents the capsule from being pushed further into the can than is desired.

20. A combination of a can and a device as claimed in claim 1 for entrapping a volume of gas under pressure within the can which later is to contain nitrogenated beer under a gaseous headspace containing nitrogen at an over pressure of at least two atmospheres comprising a capsule which is designed to retain a charge of pressurized gas for jetting a stream of gas bubbles into the beer when the can is broached prior to pouring so as to produce a frothy head on the beer when it has been dispensed, wherein the capsule is positioned generally midway up the can so that if the can is inverted the orifice in the capsule remains submerged in the beverage at all times but a liquid seal is formed around the passage means within the capsule to prevent loss of gas therefrom and so that the capsule will be charged by liquid being forced into the capsule by increasing can pressure whether the can is inverted or is upright, so that the proportion of liquid to gas which is established in the capsule during the initial pressurization of the can contents will be substantially maintained so that a predictable volume of beer will be retained in the capsule.

21. A method of packaging beer in a sealed container so that when dispensed a frothy head is formed on the beer, comprising the steps of, inserting a capsule as set forth in claim 1 into a can before filling the can with beer, partially filling the can with beer so that a space will exist in the can above the beer after the can is sealed, adding liquid nitrogen to the can before sealing the can, adding a lid to close and seal the can and thereby trap evaporating liquid nitrogen in the can to occupy the space above the beer and below the lid, said evaporation generating a significant over pressure of the gas within said space in the sealed can, processing the sealed can along a canning line to check for excessive over pressure, damage or a leaking seam between lid and can, and to pasteurize the contents of the can, causing gas in the capsule to become pressurized to the pressure of the gas trapped in said space in the can, and trapping the gas in the capsule by means of an airlock formed by the passage means within the capsule, which gas will pass through the passage means and jet through the said small orifice in the capsule when the can is subsequently opened to atmospheric pressure while upright immediately prior to dispensing the beer therefrom.

22. A method as claimed in claim 21, wherein the orifice is sealed with a temperature sensitive material before the capsule is inserted in the can so that communication with the interior of the capsule through the orifice is only effective after the contents of the can have been raised in temperature.

23. A method as claimed in claim 21, in which the capsule is secured near the base of the can and the capsule is charged with pressurized gas from said space in the can by the step of can inversion which precedes pasteurization, in a canning line.

24. A device claimed in claim 1 fitted within a beverage can.

25. The combination of a can and a device as claimed in claim 1 filled with beverage and sealed and pressurized by the addition of gas in liquid form before sealing.

26. A method of inserting a capsule into a generally cylindrical beer can having a reduced diameter neck region wherein said capsule comprises a central chamber for containing gas and a resiliently deformable bounding ring which is a close fit within the interior of said can, said central chamber and said ring being joined by non-radial spokes extending between said central chamber and said ring, and wherein said ring is deformed so as to define an oval shape to enable the capsule to be inserted through the reduced diameter neck of the can comprising the steps of twisting the can relative to the capsule so that the latter becomes co-axial with the can and pushing the capsule along the can towards an end thereof opposite the reduced diameter neck region of the can until it is in position within the can.

* * * * *